US005289181A

United States Patent [19]

Watanabe et al.

[11] Patent Number: 5,289,181

[45] Date of Patent: Feb. 22, 1994

[54] VEHICLE ALARM SYSTEM FOR INFORMING OTHER VEHICLES OF ITS OWN PRESENCE

[75] Inventors: Hiroshi Watanabe, Yokosuka; Junichi Kasai, Yokohama; Kunihiko Kurami, Kawasaki; Hiroyuki Kamishima, Yokosuka, all of Japan

[73] Assignee: Nissan Motor Co., Ltd., Japan

[21] Appl. No.: 792,178

[22] Filed: Nov. 14, 1991

[30] Foreign Application Priority Data

Nov. 29, 1990 [JP] Japan ..... 2-333181

[51] Int. Cl.[5] ..... G08G 1/00

[52] U.S. Cl. ..... 340/902; 340/436

[58] Field of Search ..... 340/901, 902, 903, 904, 340/961, 435, 436; 367/909

[56] References Cited

U.S. PATENT DOCUMENTS 3,892,483 7/1975 Säufferer ..... 340/435

4,240,152 12/1980 Duncan ..... 340/901

FOREIGN PATENT DOCUMENTS 2127451 12/1972 Fed. Rep. of Germany ..... 340/901

*Primary Examiner*—Hezron E. Williams

*Assistant Examiner*—Christine K. Oda

*Attorney, Agent, or Firm*—Lowe, Price, LeBlanc & Becker

[57] ABSTRACT

To activate an alarm generator mounted on each of other vehicles except opposing vehicles running on an opposing lane, the alarm system for an automotive vehicle which informs other vehicles of the presence of its own vehicle comprises a timing detector for detecting a timing when the alarm system is activated or deactivated; two transmitters for transmitting wide- and narrow-area alarm signals, respectively to other vehicles; two receivers for receiving wide- and narrow-area alarm signals transmitted from another vehicle, respectively; an alarm generator; and a controller for activating the alarm generator when only the wide-area alarm signal transmitted from another vehicle is received.

16 Claims, 7 Drawing Sheets

VEHICLE ALARM SYSTEM FOR INFORMING OTHER VEHICLES OF ITS OWN PRESENCE

BACKGROUND OF THE INVENTION

1. Field of the Invention

The present invention relates to a vehicle alarm system for informing other vehicles of its own presence, and more specifically to a vehicle alarm system for transmitting an alarm signal from an emergency car, for instance to other vehicles running ahead along or across the road along which the emergency car itself is travelling.

2. Description of the Prior Art

Conventionally, emergency vehicles (e.g. ambulance car, fire truck, etc.) travel by sounding a siren or blinking an alarm light. Recently, however, since almost all vehicles are running under the conditions that the vehicle windows are kept closed and the car's interior cooling apparatus is kept turned on, vehicle drivers generally have difficulty noticing the approach of an emergency vehicle, before the emergency vehicle comes close by their own vehicles. To overcome the above-mentioned problem, an alarm system for an automotive vehicle for transmitting an alarm radio wave to other vehicles (in addition to the siren and light) has been proposed.

An example of prior-art alarm systems of this type is disclosed in Japanese Published Unexamined (Kokai) Pat. Appli. No. 55-156731, as shown in FIGS. 1A and 1B. In FIG. 1B, an automotive vehicle 401 is provided with transmitting means 502 and a transmitting antenna 501. Further, two automotive vehicles 402 and 403 are provided with receiving means 504, a receiving antenna 503, and alarming means 505, respectively. In operation of this prior-art system, when the vehicle 401 transmits a radio wave from the transmitting means 502 via the transmitting antenna 501 toward the travelling direction, the vehicles 402 and 403 receive the radio wave transmitted from the vehicle 401 by the receiving means 504 via the receiving antenna 503, so that the alarming means generates an alarm to the respective drivers.

Therefore, as shown in FIG. 1A, even if the driver of the vehicle 402 cannot directly see the vehicle 401 due to the presence of a building 405, for instance, the driver can know that the vehicle 401 travelling on another road approaches an intersection.

In the prior-art alarm system as described above, however, whenever a vehicle transmits a radio wave, since the transmitted wave is received by all the vehicles running within a wave receivable area, the alarm is given to all the vehicle drivers, thus resulting in the following problem: For instance, in FIG. 1A, if the vehicle 401 travelling toward an intersection transmits a radio wave, the transmitted radio wave is received by both the vehicles 402 and 403 and the received alarm is given to both the drivers. In this case, the driver of the vehicle 403 cannot discriminate whether the alarm is transmitted from the opposing vehicle 401 travelling on the same road or the vehicle 402 travelling on a road crossing the same road. In other words, where there exists an opposing vehicle, the driver cannot discriminate whether the current alarm is transmitted from the opposing vehicle or another vehicle.

SUMMARY OF THE INVENTION

With these problems in mind, therefore, it is the object of the present invention to provide an alarm system which can transmit an alarm to other vehicles travelling on a road crossing at a forward intersection, without transmitting an alarm to opposing vehicles directly recognizable by eyesight, thus improving the safety of the alarm system.

To achieve the above-mentioned object, the claim system for an automotive vehicle according to the present invention, for informing other vehicles of the presence of its own vehicle, comprises: (a) timing detecting means (109) for detecting a timing when the alarm system is activated or deactivated; (b) first transmitting means (100) for transmitting a first alarm signal to other vehicles running in a first area ahead of the own vehicle; (c) second transmitting means (102) for transmitting a second alarm signal to other vehicles running in a second area ahead of the own vehicle; (d) first receiving means (110) for receiving the first alarm signal transmitted from another vehicle; (e) second receiving means (112) for receiving the second alarm signal transmitted from another vehicle; (f) alarm generating means (114) for generating an alarm to an own vehicle driver; and (g) control means (104) connected to said timing detecting means, said first and second transmitting and receiving means and said alarm generating means, for activating said alarm generating means only when said first receiving means receives the first alarm signal transmitted from another vehicle and deactivating said alarm generating means when both said first and second receiving means receive the first and second alarm signals transmitted from another vehicle simultaneously, so that an alarm signal can be transmitted to other vehicles except opposing vehicles.

The timing detecting means (109) comprises third receiving means (106) for receiving an alarm request signal transmitted by fixed alarm request transmitting means (220) arranged on the vehicle incoming side in the vicinity of an intersection or a curved road and an alarm stop signal transmitted by fixed alarm stop transmitting means (222) arranged on the vehicle outgoing side in the vicinity of an intersection or a curved road, the alarm system being activated in response to the alarm request signal and deactivated in response to the alarm stop signal. The timing detecting means (109) further comprises vehicle speed sensing means (108), a time difference between when said third receiving means (106) detects the alarm request signal and when the first and second transmitting means (100, 102) are activated is decreased with increasing vehicle speed detected by said vehicle speed sensing means. Or else, the timing detecting means (310) is a vehicle route guidance system which comprises: (a) map data storing means (301) for storing map data; (b) travel distance detecting means (302) for detecting travel distances of the own vehicle; (c) direction sensing means (303) for detecting travel directions of the own vehicle; (d) input means (305) for inputting departure and arrival points to determine a guidance route; and (e) calculating means (304) connected to the map data storing means, travel distance detecting means, direction sensing means and input means, for determining vehicle travel distances and directions on the basis of the detected results of said travel distance detecting means and said direction sensing means, and discriminating the current location by comparing the determined travel distances and directions with map data read from said map data storing means to check whether the own vehicle approaches or has passed through an intersection or a curved road, the alarm system being activated when the vehicle approaches an intersection or a curved road and deactivated when having passed through the intersection or the curved road.

Further, to achieve the above-mentioned object, the alarm method for an automotive vehicle according to the present invention, of informing other vehicles of the presence of its own vehicle, comprising the steps of: (a) checking whether the vehicle approaches an intersection or a curved road; (b) if approaching an intersection or a curved road, activating two receiving means for receiving wide- and narrow-area alarm signals transmitted from another vehicle; (c) further activating two transmitting means for transmitting wide- and narrow-area alarm signals to other vehicles; (d) checking whether the wide-area alarm signal from another vehicle is received; (e) if received, checking whether the narrow-area alarm signal from another vehicle is received; (f) if not received, activating alarm generating means to generate an alarm; (g) checking whether the wider- and narrow-area alarm signals are transmitted beyond a predetermined time duration; and (h) if beyond the predetermined time duration, deactivating the two transmitting means.

In the alarm system according to the present invention, when the vehicle approaches an intersection or a curved road, a first wide-area alarm signal and a second narrow-area alarm signal are transmitted to other vehicles so as to be distinguishable from each other; and an alarm is generated in the other vehicle where only the first wide-area alarm signal can be received and an alarm is not generated in the other vehicle where both the first wide-area and second narrow-area alarm signals can be received simultaneously, so that it is possible to activate the alarm generating means of the other vehicles except opposing other vehicles.

Further, the approach and passing through an intersection or a curved road can be detected by receiving alarm request and stop signals transmitted from fixed transmitting means arranged near an intersection or a curved road or by using a vehicle route guidance system.

DETAILED DESCRIPTION OF THE PREFERRED EMBODIMENTS

Embodiments of the present invention will be explained hereinbelow with reference to the attached drawings.

Figure 1A:
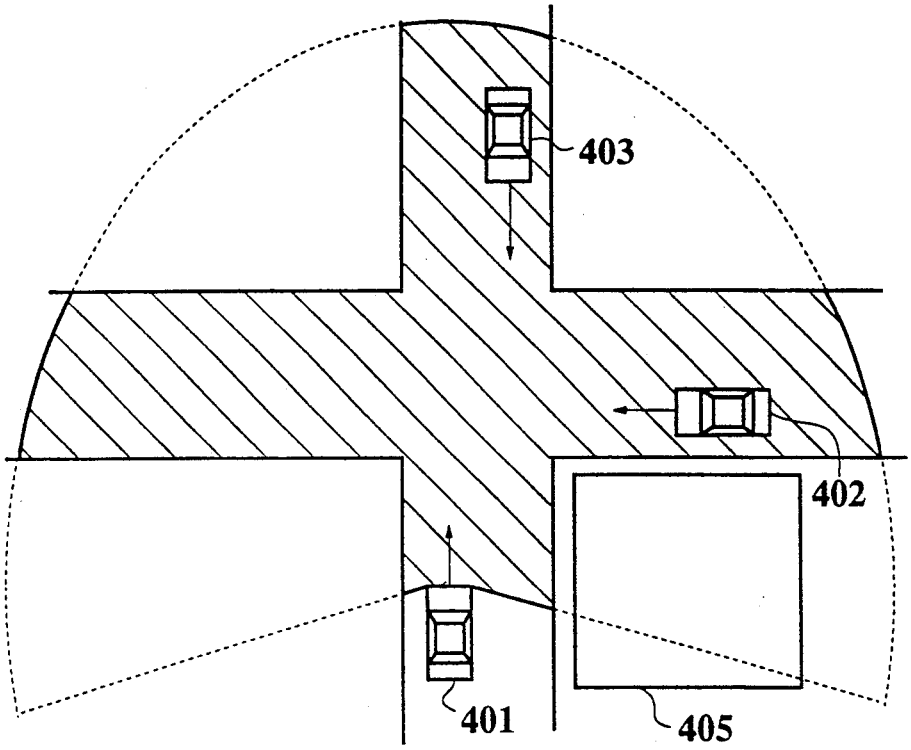
FIG.1A PRIOR ART
FIG. 1A is an illustration for assistance in explaining a problem involved in the prior-art alarm system.
Figure 1B:
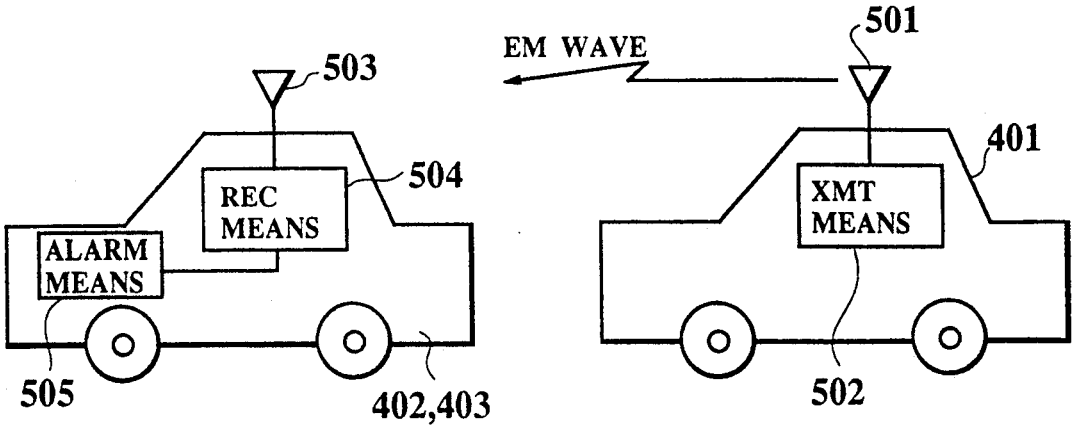
FIG.1B PRIOR ART
FIG. 1B is an illustration for assistance in explaining the operation of the prior-art alarm system.
Figure 2:
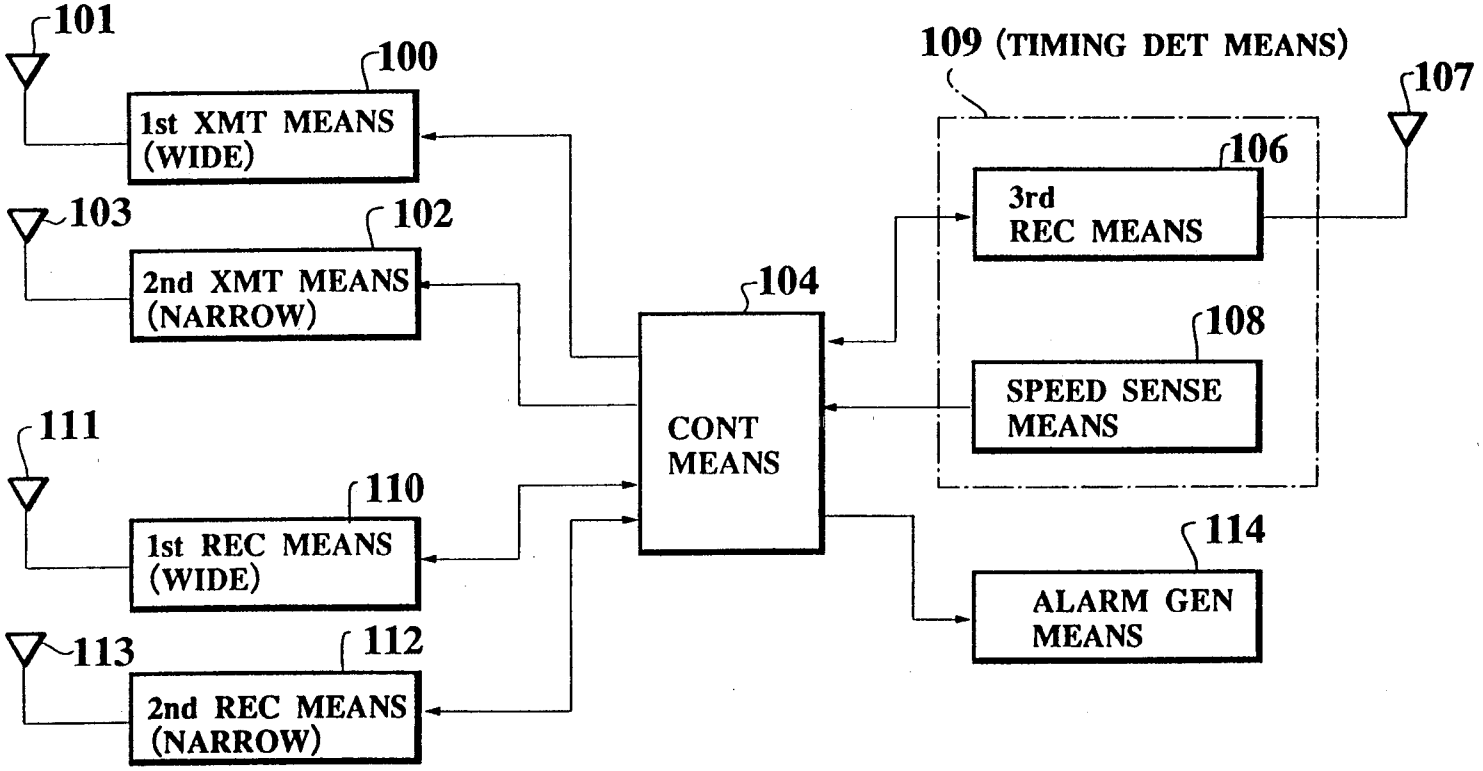
FIG. 2 is a block diagram showing a first embodiment of the alarm system according to the present invention.
Figure 3:
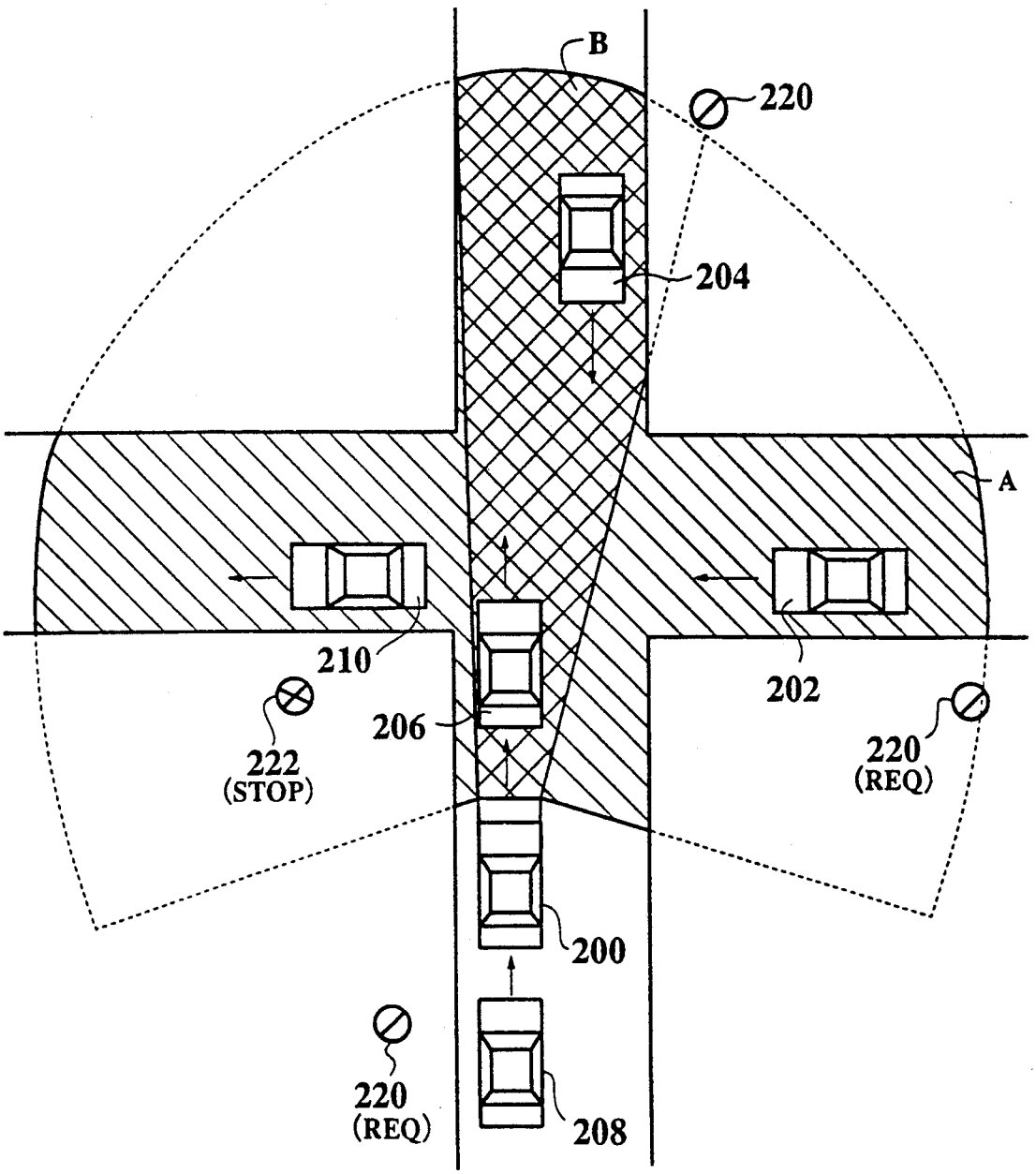
FIG. 3 is an illustration for assistance in explaining the operation of the first embodiment.

FIG. 2 is a block diagram showing a first embodiment of the alarm system mounted on an automotive vehicle according to the present invention, and FIG. 3 is an illustration for assistance in explaining vehicles and alarm systems for the vehicles.

In FIG. 2, the system comprises control means 104; first transmitting means 100 connected to a first antenna 101; second transmitting means 102 connected to a second antenna 103; first receiving means 110 connected to a third antenna 111; second receiving means 112 connected to a fourth antenna 113; timing detecting means 109 composed of third receiving means 106 connected to a fifth antenna 107 and speed sensing means 108; and alarm generating means 114.

The first transmitting means 100 transmits a wide-area alarm signal via the first antenna 101, and the second transmitting means 102 transmits a narrow-area alarm signal via the second antenna 103. The first receiving means 110 receives a wide-area alarm signal transmitted from another vehicle via the third antenna 111, and the second receiving means 112 receives a narrow-area alarm signal transmitted from another vehicle via the fourth antenna 113. These transmitting means 100 and 102 and receiving means 110 and 112 are all connected to the control means 104. The control means 104 controls the start and end of transmitting and receiving these alarm signals.

The third receiving means 106 of the timing detecting means receives an alarm request signal transmitted by fixed alarm request transmitting means 220 (shown in FIG. 3 and described later) via the fifth antenna 107 and outputs the alarm request signal to the control means 104 to activate the alarm system and further receives an alarm stop signal transmitted by fixed alarm stop transmitting means 222 (shown in FIG. 3 and described later) via the fifth antenna 107 and outputs the alarm stop signal to the control means 104 to deactivate the alarm system.

The vehicle speed sensing means 108 detects vehicle speeds. The alarm generating means 114 outputs an alarm to the driver. These means 106, 108 and 114 are all connected to the control means 104.

The transmission medium of these alarm signals is an electromagnetic (radio) wave, for instance. In this case, the frequency of the wide-area alarm signal is a first frequency and that of the narrow-area alarm signal is a second frequency, so that both the alarm signals can be discriminated. Without being limited to the electromagnetic wave, laser beams, ultrasonic waves, etc. can be used as the alarm signal transmitting medium. Further, without being limited to the frequency, the alarm signals can be discriminated on the basis of phase modulation, PCM (pulse code modulation), etc.

In FIG. 3, all the vehicles 200, 202, 204, 206, 208, and 210 are provided with the alarm system as shown in FIG. 2, respectively. Further, there are arranged fixed alarm request transmitting means 220 for transmitting an alarm request signal (to request an alarm signal transmission to vehicles) on the vehicle incoming side in the vicinity of an intersection, and fixed alarm stop transmitting means 222 for transmitting an alarm stop signal (to stop the alarm signal transmission to vehicles) on the vehicle outgoing side in the vicinity of an intersection. These alarm request and stop transmitting means 220 and 222 are used only to transmit a position signal to vehicles travelling on roads, that is, within an extremely narrow area. Without being limited to radio waves, infrared rays, ultrasonic waves can be used as the transmission medium of these transmitting means 220 and 222.

Figure 4:
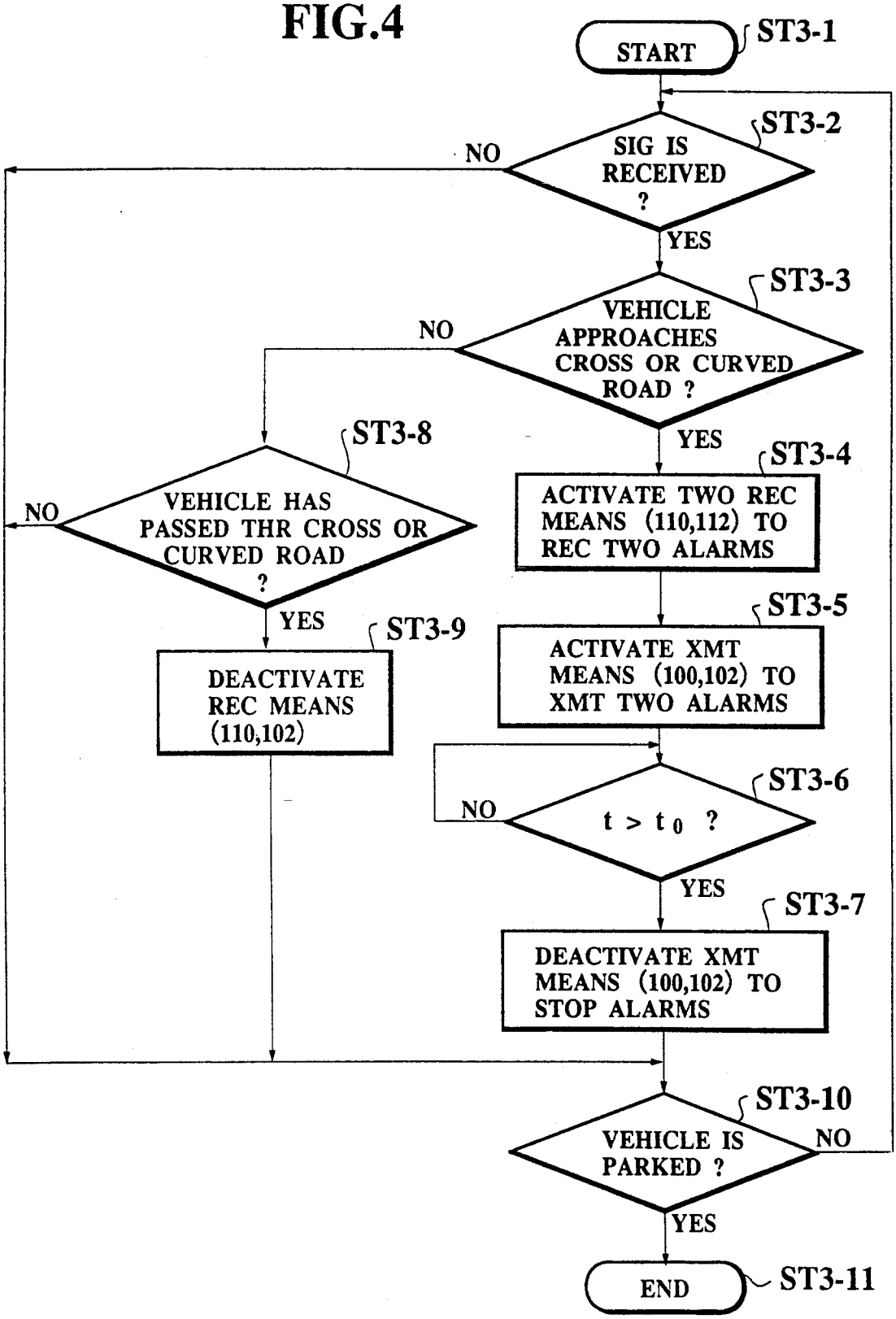
FIG. 4 is a flowchart for assistance in explaining the processing procedure of receiving the position signals.
Figure 5:
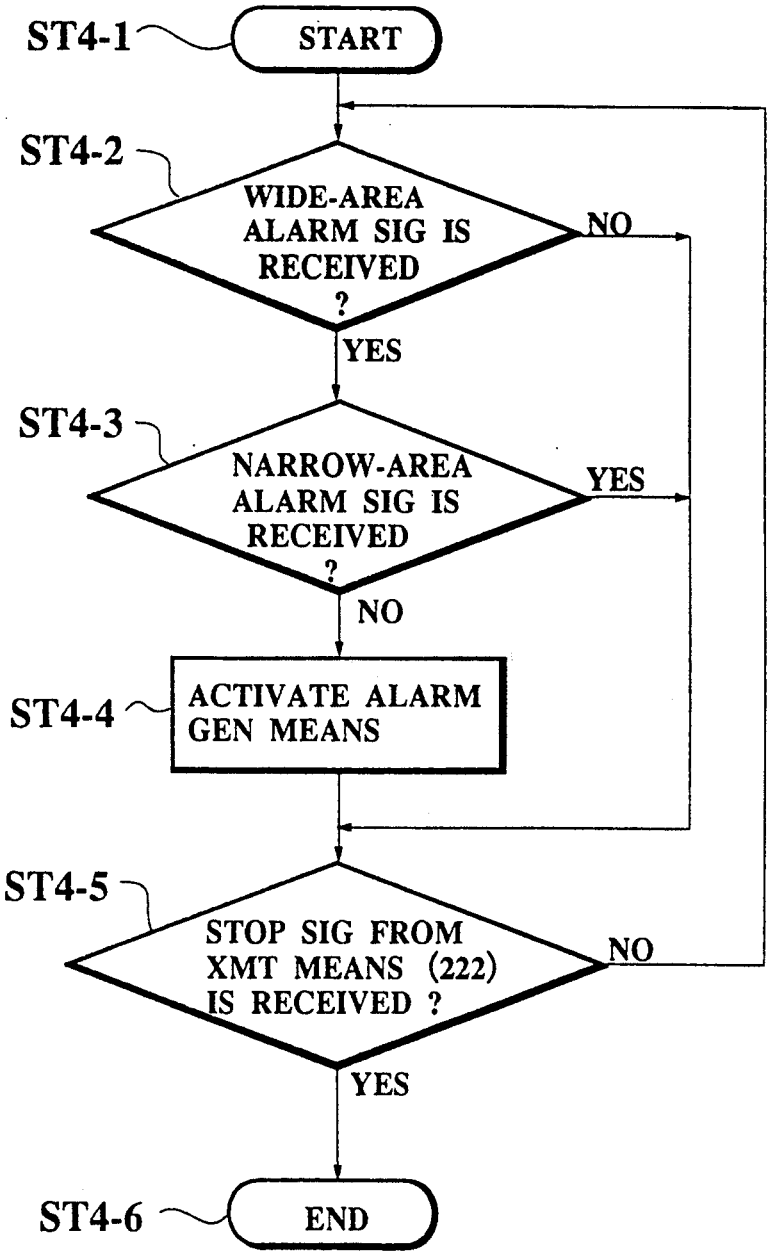
FIG. 5 is a flowchart for assistance in explaining the processing procedure of receiving the alarm signals.

The operation of the embodiment will be described hereinbelow with reference to flowcharts shown in FIGS. 4 and 5.

First, the operation of receiving the position (alarm request and stop) signals transmitted from the transmitting means 220 and 222 provided on the road side will be explained with reference to the flowchart shown in FIG. 4.

Step 3-1: When an ignition switch, for instance is turned on, a voltage is supplied to the alarm system mounted on an automotive vehicle, so that the alarm system starts to operate.

Step 3-2: The control means 104 outputs a command signal to the third receiving means 106 to activate the receiving means 106, so that the third receiving means 106 becomes the receivable state. If the third receiving means 106 detects a position signal, control proceeds to step 3—3. If does not detect a position signal, control proceeds to step 3-10.

Step 3—3: The control means 104 discriminates whether the received position signal is transmitted from the fixed alarm request transmitting means 220 or not, in order to discriminate whether the own vehicle goes into a cross or curved road or not. If the control means 104 determines that the received position signal is transmitted from the alarm request transmitting means 220, control proceeds to step 3-4. If not, control proceeds to step 3-8.

Step 3-4: The control means 104 outputs a command signal to the first and second receiving means 110 and 112 to activate them, so that the receiving means 110 and 112 become the receivable state, respectively. Thereafter, control proceeds to step 3-5.

Step 3-5: The control means 104 outputs a command signal to the first and second transmitting means 100 and 102 to activate them, so that the transmitting means 100 and 102 become the transmittable state. The first transmitting means 100 transmits a first wide-area alarm signal of a first frequency via the first antenna 101 to a first wide area including the two crossing roads (as shown by A in FIG. 3). At the same time, the second transmitting means 102 transmits a second narrow-area alarm signal of a second frequency via the second antenna 103 to a second narrow area including a lane on which the own vehicle is now travelling and an opposite lane (as shown by B in FIG. 3). Control then proceeds to step 3-6.

Step 3-6: The control means 104 monitors the time period t during which the transmitting means 100 and 102 are transmitting alarm signals, and discriminates whether the time period t exceeds a predetermined time period $t_0$ or not. If t exceeds $t_0$, control proceeds to step 3-7, and if t does not exceed $t_0$, control repeats step 3-6 until t exceeds $t_0$.

Step 3-7: The control means 104 outputs a command signal to the transmitting means 100 and 102 to deactivate them, so that the transmitting means 100 and 102 stop transmitting the wide- and narrow-area alarm signals. Control proceeds to step 3-10.

Step 3-8: The control means 104 discriminates whether the received position signal is transmitted by the transmitting means 222, that is, whether the own vehicle has passed through a crossing or a curved road. If the position signal is transmitted by the transmitting means 222, control proceeds to step 3-9. If not, control proceeds to step 3-10.

Step 3-9: The control means 104 outputs a command signal to the first and second receiving means 110 and 112 to deactivate them, so that the receiving means 110 and 112 stop receiving the alarm signals. Control proceeds to step 3-10.

Step 3-10: The control means 104 discriminates whether the own vehicle is parked or not when the ignition switch is turned off, for instance. If parked, control proceeds to step 3-11. If not parked, control returns to the step 3-2.

Step 3-11: The alarm system stops operation.

Further, the time period from when the position signal is received to when the receiving means 110 and 112 and the transmitting means 100 and 102 are activated changes according to vehicle speed. That is, when the vehicle speed is high, it is preferable that the receiving and transmitting means are activated at a position faraway from the crossing. Therefore, the own vehicle speed is detected by the vehicle speed sensing means 108 to control the time from when the position signal has been received to when the receiving and the transmitting means are activated.

The operation of processing the alarm signals transmitted by the vehicles will be described with reference to a flowchart shown in FIG. 5.

Step 4-1: When the control means 104 discriminates that the own vehicle approaches crossing in accordance with the steps from 3-1 to 3-4, the control means 104 outputs a command signal to the first and second receiving means 110 and 112 to activate them, so that the receiving means 110 and 112 becomes the receivable state. Control proceed to step 4-2.

Step 4-2: The control means 104 discriminates whether the wide-area alarm signal of the frequency f1 is received by the first receiving means 110 via the antenna 111. If the wide-area alarm is received, control proceeds to step 4-3. If not received, control proceeds to step 4-5.

Step 4-3: The control means 104 discriminates whether the narrow-area alarm signal of the frequency f2 is received by the second receiving means 112 via the antenna 113. If received, control proceeds to step 4—4. If not received, control proceeds to step 4-5.

Step 4—4: The control means 104 outputs a control signal to the alarm generating means 114, so that an alarm (e.g. sound, light, etc.) is generated to the driver. Control proceeds to step 4-5.

Step 4-5: The control means 104 discriminates whether the position signal is received by the third receiving means 106 via the antenna 107. If not received, control returns to step 4-2. If received, control proceeds to step 4-6.

Step 4-6: Since the position signal from the transmitting means 222 has been received, the control means 104 discriminates that the vehicle has passed through a crossing or a curved road and outputs a command signal to the receiving means 110 and 112 to deactivate them, so that the receiving means 110 and 112 stop operating.

The alarm operation at a crossing will be explained in practice with reference to FIGS. 2 and 3. That is, the operations of the respective vehicles 202, 204, 206, 208 and 210 will be explained when the vehicle 200 transmits the wide- and narrow-area alarm signals by the first and second transmitting means 100 and 102.

(1) Vehicle 202: Since vehicle 202 is travelling on a road (different from that on which the vehicle 200 is travelling) toward the crossing, this vehicle is located within the area A but out of the area B, as shown in FIG. 3. Therefore, the alarm system mounted on this vehicle 202 receives only the wide-area alarm signal by the first receiving means 110 via the antenna 111. In response to the wide-area alarm signal, the first receiving means 110 outputs a command signal to the control means 104. However, since the narrow-area alarm signal is not received by the second receiving means 112, the second receiving means 112 outputs no command signal to the control means 104.

The control means 104 checks a command signal inputted form the first or second receiving means 110 or 112. Since the command signal from the first receiving means 110 is detected, the control means 104 outputs a command signal to the alarm generating means 114 to activate it. Therefore, the alarm generating means 114 generates an alarm (e.g. sound, light, etc.) to the vehicle's (202) driver, to inform the driver that another vehicle 200 is travelling out of the field of vision of the driver seeing frontward along the traveling direction.

(2) Vehicle 204: Since vehicle 204 is travelling on an opposite lane of the road on which the vehicle 200 is travelling, this vehicle is located within both the areas A and B, as shown in FIG. 3. Therefore, the alarm system mounted on this vehicle 204 receives both the wide- and narrow-area alarm signals by the first and second receiving means 110 and 112 via the antennas 111 and 113, respectively. In response to the wide-area alarm signal, the first receiving means 110 outputs a command signal to the control means 104. Similarly, in response to the narrow-area alarm signal, the second receiving means 112 outputs a command signal to the control means 104.

The control means 104 checks a command signal inputted from the first or second receiving means 110 or 112. Since the command signals from both the receiving means 110 and 112 are detected, the control means 104 outputs no command signal to the alarm generating means 114. Therefore, the alarm generating means 114 generates no alarm.

(3) Vehicle 206: Since vehicle 206 is travelling on the same lane (as that on which the vehicle 200 is travelling) frontward from the vehicle 200, this vehicle is located within both the areas A and B, as shown in FIG. 3. Therefore, the alarm generating means 114 of this vehicle 206 generates no alarm, in the same way as with the case of the vehicle 204.

(4) Vehicle 208: Since vehicle 208 is travelling on the same lane (as that on which the vehicle 200 is travelling) rearward from the vehicle 200, this vehicle is located out of the area A, as shown in FIG. 3. Therefore, this vehicle cannot receive both the wide- and narrow-area alarm signals, so that the alarm generating means 114 of this vehicle 208 generates no alarm.

(5) Vehicle 210: Since vehicle 210 is travelling on a road (different from that on which the vehicle 200 is travelling) away from the crossing, this vehicle is located within the area A but out of the area B, as shown in FIG. 3. However, since this vehicle 210 receives a position (alarm stop) signal transmitted from the transmitting means 222 disposed on the vehicle outgoing side in the vicinity of the crossing, both the first and second receiving means 110 and 112 of the vehicle 210 are deactivated without receiving an alarm signal from the vehicle 200, so that the alarm generating means 114 of this vehicle 210 generates no alarm.

As described above, no alarm is transmitted to the vehicles such as those following on the same lane, running on the opposite lane, having already passed through a crossing, etc., because it is unnecessary to inform these vehicles of the presence of the own vehicle. However, an alarm is transmitted to only the vehicle running toward an intersection along another road crossing the road on which the own vehicle is running.

Therefore, even if it is difficult for other vehicles' drivers to visually recognize the running of the own vehicle due to the presence of a building or other obstacles, it is possible to allow the other vehicles' drivers (running toward an intersection along another road crossing the road on which the own vehicle is running) to recognize the presence of the own vehicle, under discrimination of other vehicles not to be alarmed from the other vehicles to be alarmed.

Further, in FIG. 3, various vehicles running in the vicinity of an intersection are explained by way of examples. It is also possible to provide the transmitting means 220 and 222 along a curved road (along which the driver cannot see ahead). In this case, the transmitting means 220 is arranged on the incoming side of the curved road and the transmitting means 222 is arranged on the outgoing side thereof. That is, it is possible to provide an alarm to a driver of an opposing vehicle difficult to see directly, so that the opposing driver can take precautions against the own vehicle.

Figure 6:
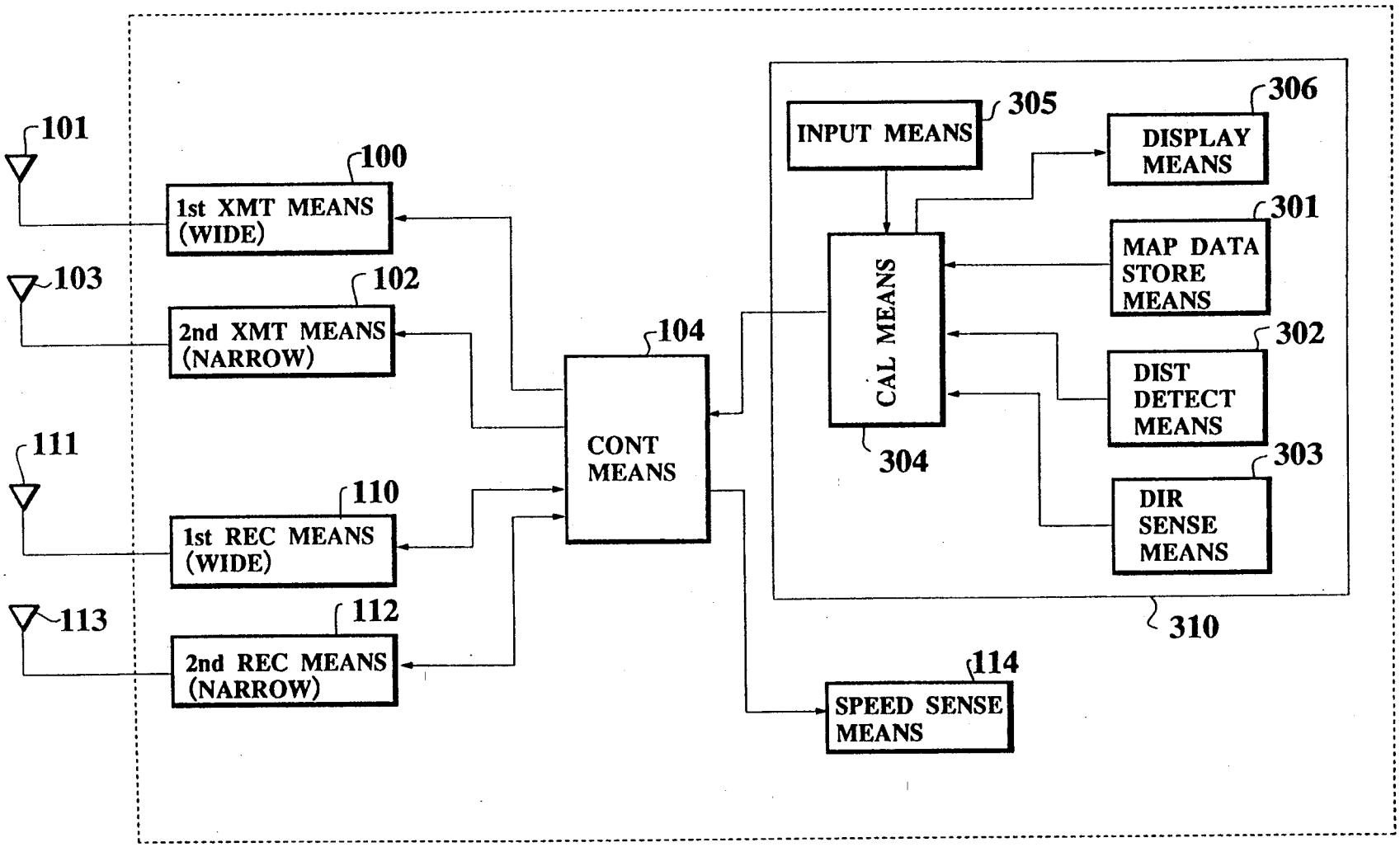
FIG. 6 is a block diagram showing a second embodiment of the alarm system according to the present invention.
Figure 7:
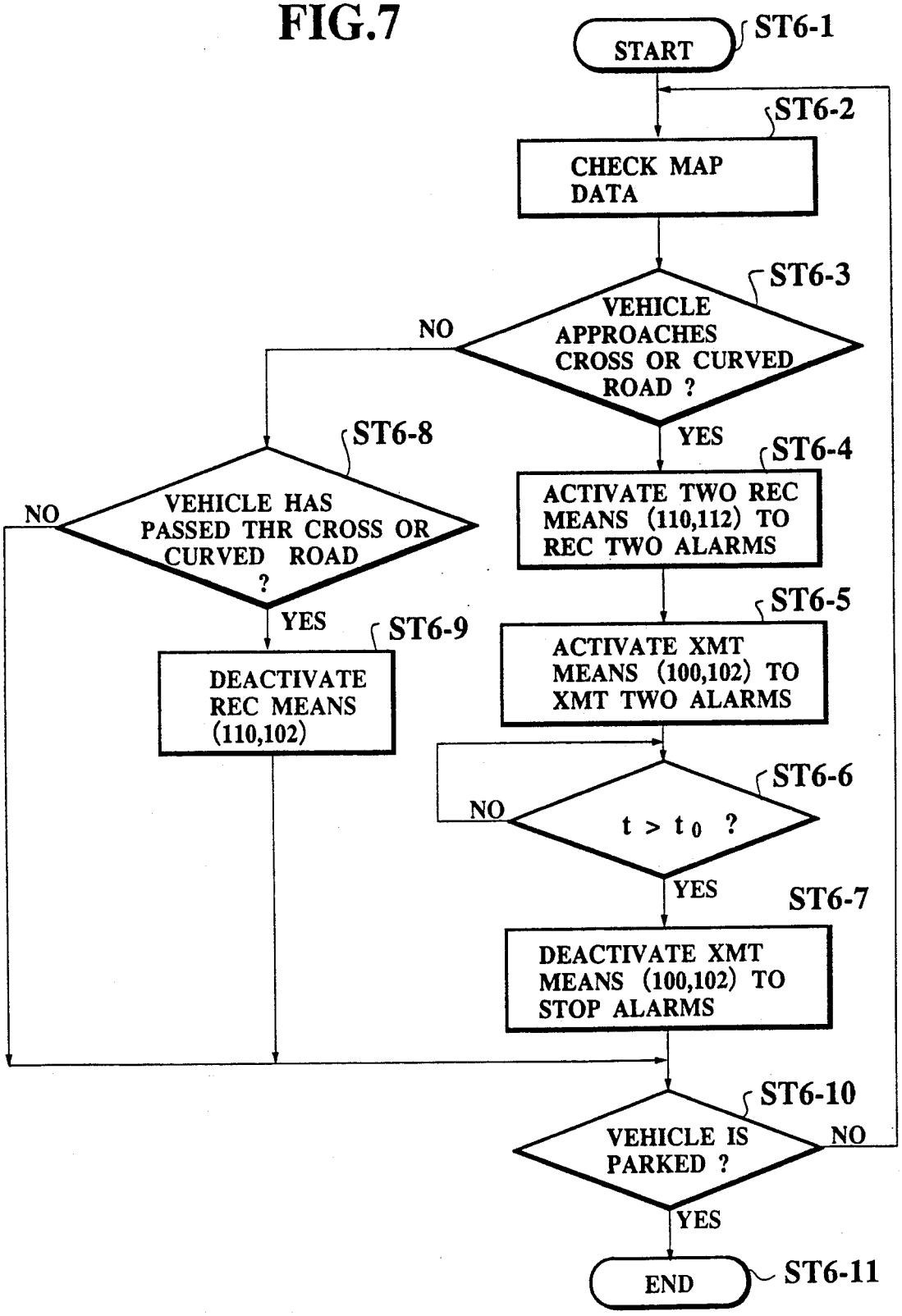
FIG. 7 is a flowchart for assistance in explaining the operation procedure of the second embodiment.

FIG. 6 shows a second embodiment of the present invention, and FIG. 7 shows a flowchart for assistance in explaining the operation of this embodiment. In this embodiment, a vehicle route guidance system is used as the timing detecting means. The vehicle route guidance system can guide a vehicle along a previously determined route.

In FIG. 6, the alarm system further comprises a guidance system 310 composed of map data storing means 301 for storing information data of a road map; travel distance detecting means 302 for measuring vehicle travel distances; direction sensing means 303 for measuring vehicle travelling directions; calculating means 304; input means 305, and display means 306. The calculating means 304 is connected to all the remaining means 301, 302, 303, 305 and 306.

The construction other than the above is the same as with the case of the first embodiment shown in FIG. 2. Therefore, the same reference numerals have been retained for similar composing elements which have the same functions, without repeating any detailed description of them.

The operation of this embodiment will be described hereinbelow with reference to the flowchart shown in FIG. 7.

Step 6-1: After the ignition switch has been turned on, when a main switch of the guidance system 310 is turned on, voltage is supplied from a battery to the guidance system 310, so that the calculating means 304 is initialized. Under these conditions, information data related to departure and arrival points are inputted through the input means 305 to determine a guidance route. Then, the calculating means 304 reads map data at the departure point from the map data storing means 301, proceeding to step 6-2.

Step 6-2: The travel distance detecting means 302 detects vehicle travel distances, and the direction sensing means 303 detects vehicle travel directions. The calculating means 304 determines the vehicle travel distances and directions on the basis of the results of the travel distance detecting means 302 and the direction sensing means 303, and further determines the current location by comparison of the determined travel distances and direction with map data read from the map data storing means 301.

Step 6-3: The calculating means 304 discriminates whether there exists an intersection or a curved road within a predetermined distance ahead of the vehicle in comparison between the vehicle current location discriminated by the calculating means 304 and map data read from the map data storing means 301. That is, the calculating means discriminates whether the vehicle enters an intersection or a curved road. If the calculating means 304 determines that the own vehicle will enter an intersection or a curved road, the calculating means 304 outputs a signal to the control means 104, proceeding to step 6-4. If not, control proceeds to step 6-8.

Steps 6-4 to 6-7: These steps are the same as the steps 3-4 to 3-7 shown in FIG. 4, respectively. Therefore, the description thereof is omitted herein.

Step 6-8: The calculating means 304 discriminates whether the own vehicle has passed through an intersection or a curved road on the basis of the current vehicle location determined by the calculating means 304 and the map data read from the map data storing means 301. If the calculating means 304 determines that the vehicle has passed through an intersection or a curved road, the calculating means 304 output a signal to the control means 104. If not, control proceeds to step 6-10.

Steps 6-9 to 6-11: These steps are the same as the steps 3-9 to 3-11 shown in FIG. 4, respectively. Therefore, the description thereof is omitted herein.

In accordance with the above-mentioned flowchart, control discriminates whether the own vehicle will pass or has passed through an intersection or a curved road, and starts and stops the transmission and the reception of the alarm signals.

Further, the operations for receiving an alarm signal transmitted from another vehicle and for generating an alarm to the driver are the same as with the case of the first embodiment shown in FIG. 3, therefore the description thereof being omitted herein.

Further, in the above embodiment, the guidance system 310 deduces a vehicle running route on the basis of data detected by the travel distance detecting means 302 and the direction sensing means 303 to detect an own vehicle location. Without being limited thereto, however, it is of course possible to adopt the guidance system for detecting the vehicle location by receiving an electromagnetic wave transmitted by a communications satellite.

Further, it is also possible to use an image recognizing system as the timing detecting means. In more detail, an intersection can be detected when the image recognizing system recognizes a road sign board indicative of an intersection, and the entering into a curved road can be detected when the image recognizing system recognizes a road condition on the basis of a white line mark described at the center of a road or on the road side. On the basis of these results detected by the image recognizing system, the timings at which alarm signals are transmitted or received are determined.

As explained on the basis of the practical embodiments, when a vehicle travelling on a road detects a predetermined location, the first and second transmitting means transmit first (wide-area) and second (narrow-area) alarm signals discriminatable from each other; other vehicles travelling within a first (narrow) area receive both the first and second alarm signals and therefore an alarm is not given to the other vehicles'-drivers; other vehicles travelling within a first (wide) area but out of a second (narrow) area receive only the first (wide-area) alarm signal and therefore an alarm is given to the drivers. That is, since it is possible to give an alarm to only vehicles existing within a predetermined area, the drivers of the other vehicles which receive an alarm can know the position of a vehicle which transmits the alarm.

What is claimed is:

1. An alarm system for an automotive vehicle, for informing other vehicles of the presence of its own vehicle and for informing a driver of its own vehicle of the presence of other vehicles, comprising in each vehicle:

(a) timing detecting means for detecting a timing when the alarm system is activated and deactivated;

(b) first transmitting means for transmitting a first alarm signal to said other vehicles traveling within a first area ahead of its own vehicle;

(c) second transmitting means for transmitting a second alarm signal to said other vehicles traveling within a second area ahead of its own vehicle;

(d) first receiving means for receiving a first alarm signal transmitted from a first transmitting means in one of said other vehicles;

(e) second receiving means for receiving a second alarm signal transmitted from a second transmitting means in said one of said other vehicles;

(f) alarm generating means for generating an alarm to a driver of its own vehicle; and (g) control means connected to said timing detecting means, said first and second transmitting means, said first and second receiving means and said alarm generating means, for activating said alarm generating means of its own vehicle only when said first receiving means receives said first alarm signal transmitted from said one of said other vehicles and deactivating said alarm generating means when both said first and second receiving means of its own vehicle simultaneously receive said first alarm signal and said second alarm signal transmitted from said one of said other vehicles.

2. The alarm system of claim 1, wherein said timing detecting means comprises third receiving means for receiving an alarm request signal transmitted by fixed alarm request transmitting means arranged on a vehicle incoming side in the vicinity of an intersection or a curved road and for receiving an alarm stop signal transmitted by fixed alarm stop transmitting means arranged on a vehicle outgoing side in the vicinity of the intersection or the curved road, said control means activating the alarm system of its own vehicle in response to reception by said third receiving means of its own vehicle of the alarm request signal and deactivating the alarm system of its own vehicle in response to reception by said third receiving means of its own vehicle of the alarm stop signal.

3. The alarm system of claim 2, wherein said timing detecting means further comprises vehicle speed sensing means and means for decreasing a difference between a time when said third receiving means detects the alarm request signal and a time when the first and second transmitting means of its own vehicle are activated in response to detection of increasing vehicle speed by said vehicle speed sensing means of its own vehicle.

4. The alarm system of claim 1, wherein said timing detecting means comprises a vehicle route guidance system which includes:

(a) map data storing means for storing map data;
(b) travel distance detecting means for detecting travel distances of its own vehicle;
(c) direction sensing means for detecting travel directions of its own vehicle;
(d) input means for inputting departure and arrival points to determine a guidance route for its own vehicle; and
(e) calculating means connected to the map data storing means, travel distance detecting means, direction sensing means and input means, for determining vehicle travel distances and directions of its own vehicle in response to detected results of said travel distance detecting means and said direction sensing means, and discriminating current location of its own vehicle by comparing the determined travel distances and directions of its own vehicle with map data read from said map data storing means to check whether its own vehicle approaches an intersection or a curved road and to check whether its own vehicle has passed through the intersection or curved road, said control means activating the alarm system of its own vehicle when its own vehicle approaches an intersection or a curved road and deactivating the alarm system of its own vehicle when its own vehicle has passed through the same intersection or the same curved road.

5. The alarm system of claim 1, wherein the first alarm signal is a wide area radio signal and the second alarm signal is a narrow area radio signal.

6. The alarm system of claim 1, wherein the first alarm signal is a wide area laser beam and the second alarm signal is a narrow area laser beam.

7. The alarm system of claim 1, wherein the first alarm signal is a wide area ultrasonic wave and the second alarm signal is a narrow area ultrasonic wave.

8. The alarm system of claim 1, wherein the first and second alarm signals are discriminated on the basis of a difference in frequency.

9. The alarm system of claim 1, wherein the first and second alarm signals are discriminated on the basis of a difference in phase.

10. The alarm system of claim 1, wherein the first and second alarm signals are discriminated on the basis of a difference in pulse code.

11. An alarm method for an automotive vehicle for informing other vehicles of the presence of its own vehicle, comprising the steps of:

(a) checking whether its own vehicle approaches an intersection or a curved road;
(b) if approaching the intersection or the curved road, activating two receiving means for receiving wide- and narrow-area alarm signals transmitted from another vehicle;
(c) further activating two transmitting means for transmitting wide- and narrow-area alarm signals to other vehicles;
(d) checking whether the wide-area alarm signal from another vehicle is received;
(e) if the wide-area alarm signal is received from another vehicle, checking whether the narrow-area alarm signal from another vehicle is received;
(f) if the narrow-area alarm signal from another vehicle is not received, activating alarm generating means to generate an alarm for its own driver;
(g) checking whether the wide- and narrow-area alarm signals are transmitted from its own vehicle beyond a predetermined time duration; and
(h) if transmitted beyond the predetermined time duration, deactivating the two transmitting means.

12. The alarm method of claim 11, which further comprises the steps of:

(a) checking whether its own vehicle has passed through the intersection or the curved road;
(b) if having passed, deactivating the two receiving means;
(c) checking whether its own vehicle is parked; and
(d) if parked, ending control.

13. The alarm method of claim 11, wherein the approach of its own vehicle to the intersection or the curved road is checked by receiving an alarm request signal transmitted from a fixed alarm request transmitting means arranged on a vehicle incoming side in the vicinity of the intersection or the curved road.

14. The alarm method of claim 12, wherein the passing of its own vehicle through the intersection or the curved road is checked by receiving an alarm stop signal transmitted from a fixed alarm stop transmitting means arranged on vehicle outgoing side in the vicinity of the intersection or the curved road.

15. The alarm method of claim 11, wherein the approach and passing of its own vehicle to and through the intersection or the curved road is checked by a vehicle route guidance system.

16. The alarm method of claim 12, wherein the approach and passing of its own vehicle to and through the intersection or the curved road is checked by a vehicle route guidance system.

* * * * *